US006644215B1

(12) United States Patent
Mundinger

(10) Patent No.: US 6,644,215 B1
(45) Date of Patent: Nov. 11, 2003

(54) WORM DRIVE MECHANISM FOR GEAR OPERATED DOOR

(76) Inventor: William D. Mundinger, 7717 Youngstown-Salem Rd., Canfield, OH (US) 44406

( * ) Notice: Subject to any disclaimer, the term of this patent is extended or adjusted under 35 U.S.C. 154(b) by 0 days.

(21) Appl. No.: 10/154,260

(22) Filed: May 23, 2002

(51) Int. Cl.[7] ..... B61D 7/04

(52) U.S. Cl. ..... 105/240; 105/253; 105/290; 105/307

(58) Field of Search ..... 105/240, 253, 105/283, 290, 307, 359

(56) References Cited

U.S. PATENT DOCUMENTS 3,373,700 A * 3/1968 DeRidder ..... 105/240
3,815,514 A * 6/1974 Heap ..... 105/240
3,818,842 A * 6/1974 Heap ..... 105/240

* cited by examiner

*Primary Examiner*—S. Joseph Morano
*Assistant Examiner*—Lars A Olson

(57) ABSTRACT

An anti-spin/anti-drift or stop mechanism for a railway car door includes a shaft, a helical gear mounted to a first end of the shaft, a helical drive rotatably cooperating with the gear, and a worm gear mounted on a second end of the shaft. The worm gear is disposed in continuous engagement with a gear segment by means of intermeshing gear teeth. A handle for selectively rotating the worm gear is mounted on an end of a helical drive shaft. When the handle is rotated to move the railcar door to a fully opened position, the worm gear rotates the gear segment in a first direction while preventing rotation in the opposite direction to thereby eliminate the potential for drifting of the door. Also, as the handle is rotated to move the railcar door to a fully closed position, the worm gear rotates the gear segment in one direction while preventing rotation in the opposite direction to eliminate the potential for spinning of the handle.

22 Claims, 4 Drawing Sheets

WORM DRIVE MECHANISM FOR GEAR OPERATED DOOR

BACKGROUND OF THE INVENTION

The present invention relates generally to the art of railway cars. More particularly, the invention pertains to a worm gear drive mechanism for gear operated railway car doors.

The invention is particularly applicable to rectangular metal doors of the type used on railway freight cars, and will be particularly described with reference thereto. However, it will be appreciated by those skilled in the art that the invention has broader applications and is adaptable to use with other types of doors and in other environments.

Rectangular metal doors of a known type used in railway cars include a generally rectangular frame typically comprised of top, bottom, and horizontal stiffeners, and opposed side members. Metal panels are secured to these frame members for completing the basic door construction. In most conventional railway cars, the frame members and metal panels are riveted and/or welded together.

Railway car doors are typically classified as either sliding doors or plug doors. Of the two, sliding doors are less complex, having a door configured to slide back and forth within a side panel of a railway car to selectively open and close an opening defined therein. Plug doors are more complex in that they are configured to first move laterally out of an opening defined in a railway car and then move longitudinally along a track disposed adjacent the railcar side panel.

Plug doors to be mounted on the side of a rail car include a series of panels or sheeting reinforced by horizontally disposed channels at the top, bottom and/or intermediate portions of the door. A pair of vertically oriented elongated support members such as pipes, rods or bars are configured to support the door on the railcar. The support members are typically provided with upper and lower cranks attached to the terminal end areas thereof which serve as lever arms for laterally moving the door into and out of the railcar door opening. Upon actuation of a driving mechanism, such as a manually operated gear assembly, the support members are rotated to cause corresponding rotation of the cranks. Rotation of the cranks, in turn, draws the door laterally outward from the opening until the door is supported on a track disposed adjacent to the side of the railcar. The door is movably supported on the track by roller hangers which enable the door to slide longitudinally along the side of the railcar.

One problem that occurs when the door is completely closed is that if a load falls against the inside wall of the door, an operating lever which controls movement of the door may spin and possibly move the door into an unwanted slightly or fully opened position.

A second problem occurs when the door is in the fully opened position. The support members have a tendency to rotate, thus causing the door to drift back into the side of the railcar. If this occurs, the ability of the door to slide longitudinally along the track may be inhibited. Furthermore, the door or the side of the railcar may become damaged because of the drifting action.

Another problem that occurs with existing railway car doors is found in a ratchet and pawl mechanism used for preventing movement of the door. That is, under certain conditions, the operating lever could still spin in spite of the pressure of a ratchet and pawl if the lever releases too fast and does not allow the pawl to engage the ratchet. This condition would occur if large forces were tending to push the door open and the operator released the lever while a rotational force was operating thereon and the pawl positioned on a peak of a ratchet tooth.

Accordingly, it has been considered desirable to develop an anti-spin/anti-drift worm drive arrangement for a gear operated door which would overcome the foregoing difficulties and others while providing better and more advantageous overall results.

SUMMARY OF THE INVENTION

In accordance with the present invention, an anti-spin/anti-drift or stop mechanism is advantageously provided comprised of a worm drive for a gear operated planar door. The door is of the type having at least one elongated support member rotatably mounted thereto and which is selectively rotated through a drive mechanism by an operating mechanism to achieve door opening and closing. The operating mechanism includes an actuating member, such as a handle, lever or the like, which facilitates selective rotation of the at least one support member. An anti-spin/anti-drift mechanism operatively communicates with the operating mechanism to prevent undesired spinning of the operating mechanism which might otherwise allow the door to shift in an uncontrolled manner from one position to another.

According to another aspect of the invention, the anti-spin/anti-drift or stop mechanism includes a worm drive which is in continuous engagement with the drive mechanism.

According to yet another aspect of the invention, the worm drive includes a worm gear which operatively engages a spur gear for allowing selective rotation of the spur gear in a predetermined direction.

In accordance with a more limited aspect of the invention, the worm drive is mounted on a bearing plate of the door adjacent the drive mechanism.

According to a further aspect of the invention, the worm drive mechanism is advantageously provided to prevent either undesired spinning of the operating mechanism or drifting of the railcar door.

A principal advantage of the present invention resides in a provision of an anti-spin/anti-drift or stop arrangement which prevents an operating lever of a door from spinning if a load falls or is otherwise applied against an inside surface of the door.

Another advantage of the invention is found in an anti-spin/anti-drift or stop arrangement which does not impede or interfere with normal door operation.

Another advantage of the present invention resides in the provision of an anti-spin/anti-drift arrangement which prevents drifting of the door from a fully opened position.

Still another advantage of the invention resides in the continuous engagement of the anti-spin/anti-drift mechanism with the drive mechanism.

Yet another advantage of the invention is the provision of an anti-spin/anti-drift or stop arrangement which is relatively low in cost.

Yet another advantage of the invention is the provision of an anti-spin/anti-drift or stop arrangement which is easy to manufacture and retrofit to existing doors.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DETAILED DESCRIPTION OF THE PREFERRED EMBODIMENTS

Figure 1:
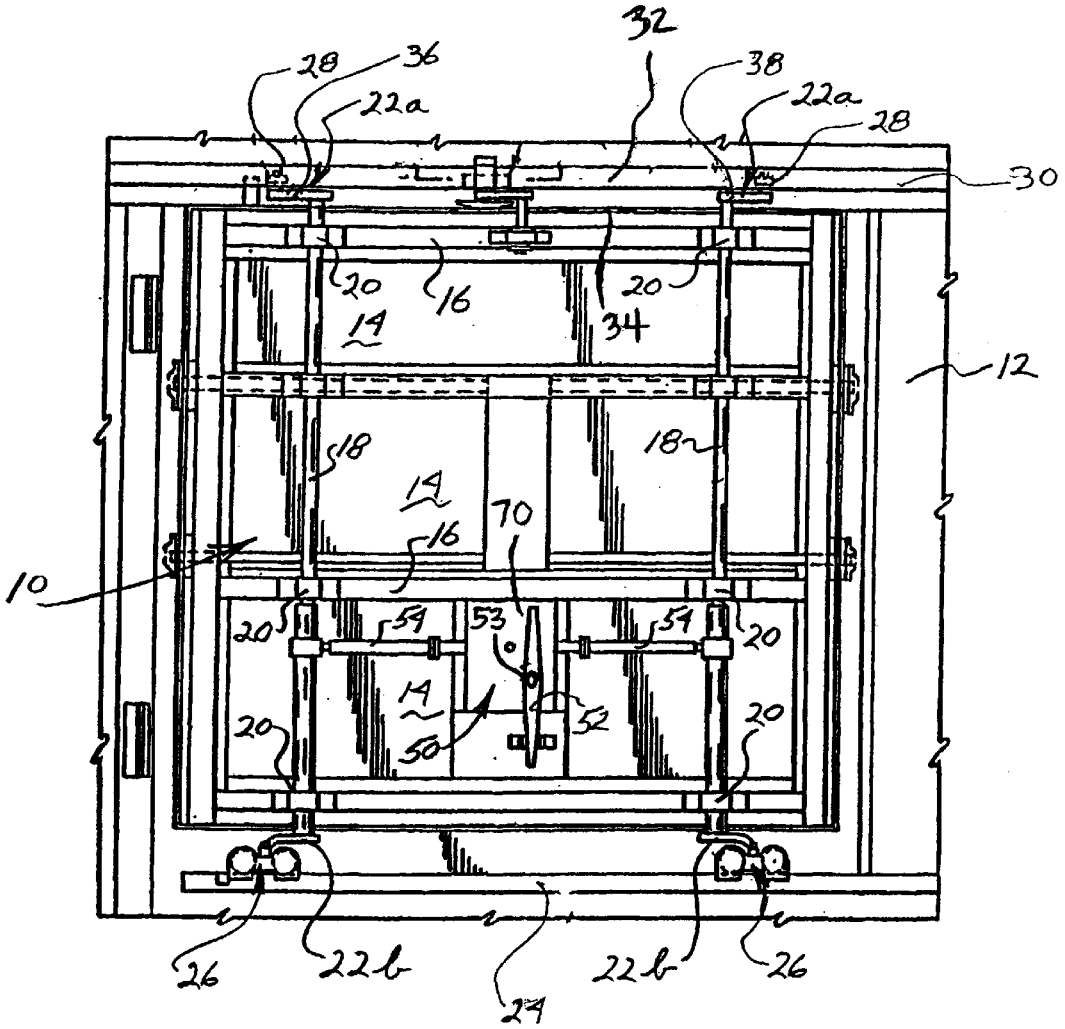
FIG. 1 is front elevational view of a plug type railway car door which includes an anti-spin/anti-drift or stop arrangement formed in accordance with a preferred embodiment of the present invention.

Referring now to the drawings wherein the showings are for purposes of illustrating a preferred embodiment of the invention only and not for purposes of limiting same, FIG. 1 shows a plug-type railcar door 10 of the type with which the subject invention is particularly useful disposed in an opening 12 in a railcar. The door includes a wall of paneling or sheeting 14 reinforced with horizontal channels 16 extending across top, bottom and intermediate portions of the sheeting. Paneling 14 is typically fabricated from metal.

The door 10 is supported by elongated support members 18, such as pipes, rods or tubes, which are disposed along the vertical height of the door. These support members are rotatably mounted to the horizontal reinforcing channels 16 at the outer surface of the door by brackets or fulcrums 20 located adjacent to the door side edges for retaining the support members in a vertical disposition.

Each of the support members 18 includes a first or upper end having a first or upper crank 22*a* and a second or lower end having a second or lower crank 22*b* operatively connected thereto. The cranks 22*a*, 22*b* serve as lever arms which enable the door to move laterally into and out of the railcar opening 12. The door 10 is adapted to move laterally out of the door opening toward the outside of the railcar until the door is supported on a track 24 disposed adjacent the railcar sidewall. The door is then moved longitudinally along the side of the car on track 24 to effectively expose the door opening and facilitate car loading and unloading. Thus, when it is in the unplugged position, the door is movably supported on the track by roller hangers 26 which are attached to the ends of the lower cranks 22*b* for guiding the door in its longitudinal movement.

Upper ends of the cranks 22*a* include pins with rollers 28 mounted for longitudinal movement within and along a top retainer rail or longitudinal retainer member 30 having a generally U-shaped cross section. Retainer 30 is mounted along the top of the door opening 12 and functions to restrain the top of the door and prevent undesired displacement thereof. Rollers 28 move along an inner surface of a downwardly depending front flange 32 of the top retainer rail. The front flange extends longitudinally and is located inside an outer edge of a laterally outward extending lower flange 34 spaced from and located below the front flange. Horizontal connecting portions 36, 38 of upper cranks 22*a* extend through the space between front flange 32 and lower flange 34, and connect the upper end of the cranks and the rollers 28 with the upper end of the support members 18. The rollers 28 are disposed behind the retainer rail 30. The combination of the rollers and the retainer rail acts to restrain the top of the car door as it is moved longitudinally along the track 24.

As is well understood in the art, rotation of the support members 18 causes a corresponding outward rotation of the cranks 22*a*, 22*b* to sequentially draw the door 10 laterally outward from the door opening 12. An operating mechanism 50 is provided on the door for controlling the rotation of the support members 18 and the cranks in a manner well known in the art. An activating member 52 in the form of a lever or handle has a mounting opening 53 therethrough for securing same to the door operating mechanism.

Figure 2:
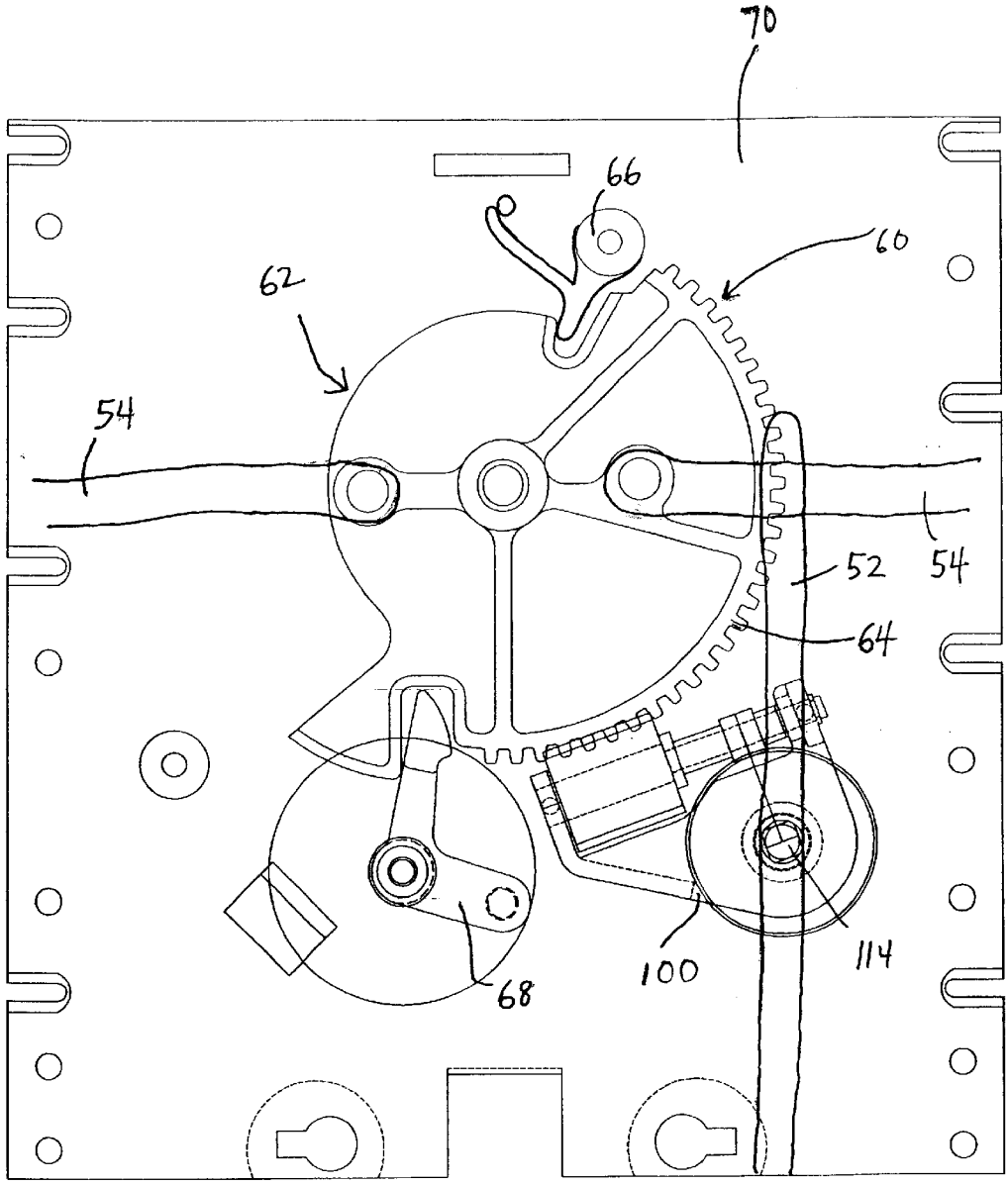
FIG. 2 is a front elevational view of a portion of the railcar door illustrating a drive gear mechanism and the anti-spin/anti-drift arrangement of the subject invention.

Referring to FIG. 2, a drive mechanism 60 preferably comprises a gear operated system or assembly 62 operatively connected to and actuated by actuating member or lever 52. The gear assembly includes a rotatably mounted spur gear segment 64 and two pivotally mounted operating cams 66, 68, each of which is housed in and positioned between a bearing plate 70 and a cover plate 72 (see FIG. 4). The bearing plate is mounted on a lower portion of the door sheeting 14, and the cover plate is bolted or otherwise secured to the bearing plate in laterally spaced apart relation thereto.

A pair of transmission members 54, such as pipes, rods or tubes, are connected at first ends to the gear segment 64 and at second ends to an associated support member 18. By rotating the lever or handle 52 counterclockwise, gear 64 is rotated clockwise which, in turn, pivots operating cams 66, 68. Rotation of the gear causes the transmission members 54 to rotate the support members 18 and cranks 22*a*, 22*b*. This rotation effects selective lateral movement of the door outwardly from the opening 12 to the outside of the railcar, thereby unsealing or unplugging the railcar opening. When the lever or handle 52 is rotated clockwise, the gear segment rotates counterclockwise for moving the door into the railcar opening to thus seal or plug the opening.

Figure 3:
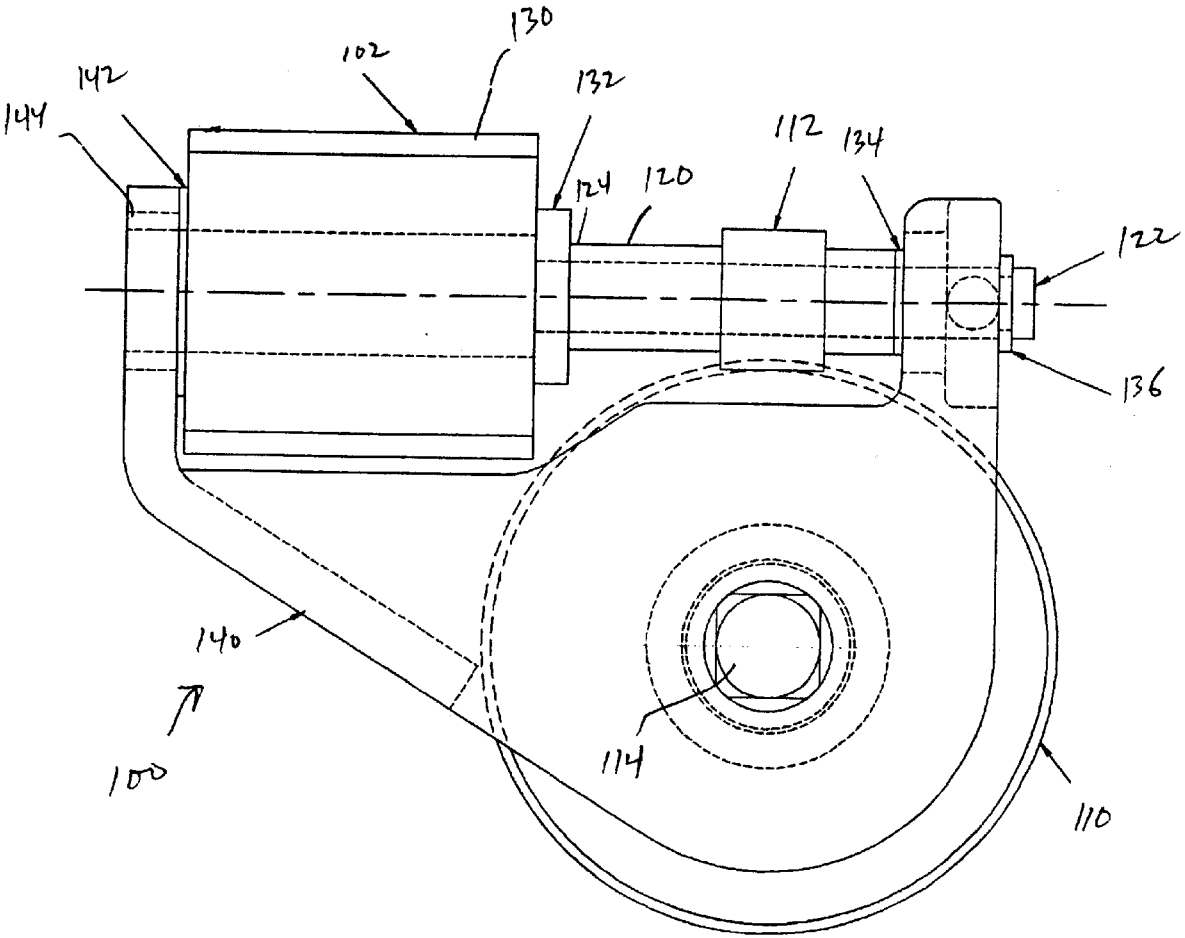
FIG. 3 is a front elevational view of the anti-spin/anti-drift mechanism; and, FIG. 4 is a side elevational view of a portion of the railcar door illustrating the anti-spin/anti-drift arrangement.
Figure 4:
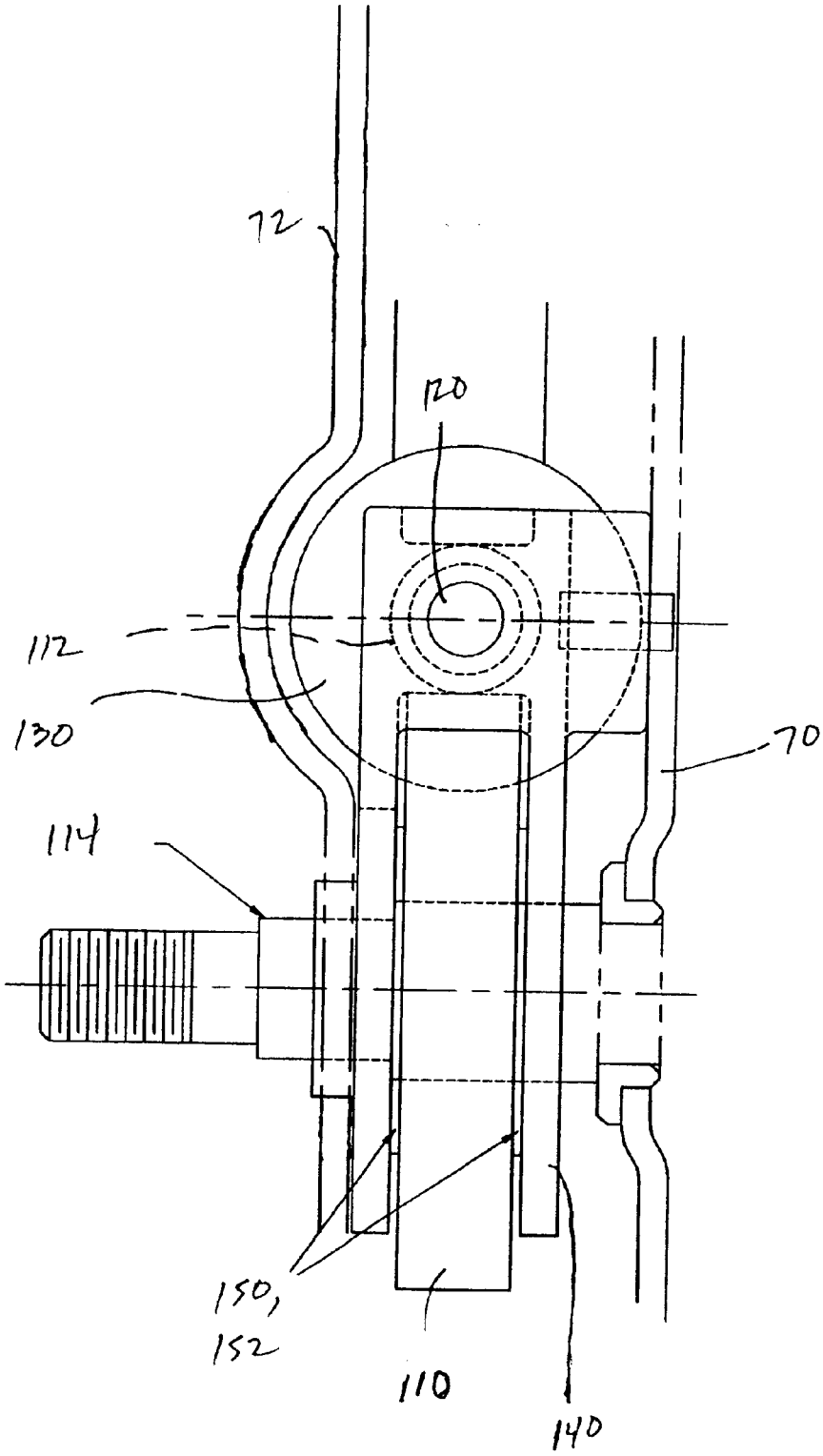

Referring to FIGS. 2, 3, and 4, an anti-spin/anti-drift mechanism 100 is advantageously disposed intermediate the bearing and cover plates. The anti-spin/anti-drift mechanism includes a worm gear drive assembly 102. As is well known, worm gears resemble screws, and are used to drive spur gears or helical gears. Worm gears allow two non-intersecting skew shafts to mesh. Typically, the two shafts are disposed at right angles to each other. Worm gears are typically used when a high gear ratio is desired or when the shafts are perpendicular to each other. One advantage of a worm gear mesh is the irreversibility; that is, when a worm gear is turned, the meshing spur gear turns; however, the turning of the spur gear does not turn the worm gear. The resulting mesh is self locking and is advantageously used as a ratcheting mechanism.

In the preferred embodiment, the worm gear assembly 102 comprises a helical drive 110 and a helical gear 112 which is positioned at 90° with respect to the helical drive. In the preferred arrangement, and simply by way of example, the helical drive is preferably four (4) inches in diameter and the helix gear is preferably one (1) inch in diameter. It will be appreciated, however, that other diameters may also be satisfactorily used.

The helical drive has a shaft 114 extending through a center portion thereof. This shaft, in turn, is threadably connected to the lever 52. The helical gear 112 is secured to a shaft 120 having a first end 122 and a second end 124 which itself has a worm gear 130 mounted thereon. A spacer 132 is interposed between worm gear 130 and the helix gear 112. A bushing 134, preferably made of bronze, and a retainer clip 136 are used to secure the worm shaft to a gear housing assembly 140 which encases the helical drive. The worm gear has a bushing 142, likewise preferably made of bronze, adjacent an arm 144 of the gear housing.

Referring to FIG. 4, the helical drive has bushings 150, 152, preferably made of bronze, on each side thereof which spaces the drive from the gear housing. As the lever 52 is rotated, the helix drive is rotated which, in turn, rotates the helical gear on the worm shaft, the worm shaft 120, and rotates the worm gear 130 on the shaft. The worm threads rotate the spur gear 64 (FIG. 2) which operates to open or close the railcar door.

To close the door, the lever 52 is rotated clockwise which rotates the helical drive 110 clockwise. This, in turn, rotates the helical gear 112, worm shaft 120 and worm gear 130 counter-clockwise so that spur gear 64 is rotated counter-clockwise to effect door closing. The lever handle 52 is rotated one or more turns to achieve closing the door.

If a load shifts or is otherwise applied to the internal wall of the door, the gear segment 64 has a tendency to rotate clockwise, thus attempting to cause the lever to spin out of control in a counter-clockwise direction and present a potentially dangerous situation. That is, once the gear segment 64 begins to rotate for opening the door, the lever 52 will also commence to spin. However, the worm gear drive mechanism of the subject invention which is engaged with the gear 64 will not rotate in response to any rotational tendency of the gear. That is, the worm gear can be used to drive the gear 64, but gear 64 cannot be used to drive the worm gear. As is well known, the worm gear mesh with the spur gear is irreversible; that is, turning the spur gear does not turn the worm gear. Accordingly, any attempt to rotate the spur gear will be prevented by the engagement of the gear teeth with the worm drive gear teeth. Thus, the lever 52 will be prevented from spinning as a result of any attempted rotation of the gear 64.

If opening of the door is desired, the lever 52 is manually rotated counter-clockwise, thus rotating the helical drive 110 counter-clockwise opposite to the manner described above. This results in clockwise rotation of the spur gear 64 until the door is fully opened. Once the door is moved onto the track 22, the support members 18 have a tendency to rotate, thus rotating the cranks 20*a*, 20*b* for potentially allowing the door to move or drift toward the side of the railcar. If the gear 64 starts or has a tendency to rotate counter-clockwise to close the door, actual rotation is again prevented due to engagement of the gear teeth with the teeth of worm 130. The gear 64 can only rotate in response to driving rotation of the worm gear. Thus, the door will remain in the open position and drifting into the side of the railcar is advantageously prevented.

The invention has been described with reference to a preferred embodiment. Obviously, modifications and alterations will occur to others upon a reading and understanding of the specification. The invention is intended to include all such modifications and alterations insofar as they come with the broad meaning and scope of the appended claims.

Having thus described the invention it is claimed:

1. A railcar door assembly comprising:

a substantially planar door;

at least one elongated support member rotatably mounted to said door;

a drive mechanism associated with said door and operatively connected to said support member for selectively rotating said support member about its longitudinal axis to partially open and close said door; and, a stop mechanism associated with said door for preventing movement of said drive mechanism when said door is in one of a partially opened and fully closed position, said stop mechanism comprising a worm gear mechanism disposed in engagement with said drive mechanism.

2. A railcar door assembly comprising:

a substantially planar door;

at least one elongated support member rotatably mounted to said door;

a drive mechanism associated with said door and operatively connected to said support member for selectively rotating said support member about its length to partially open and close said door; and, a stop mechanism associated with said door for preventing movement of said drive mechanism when said door is in one of a partially opened and fully closed position, said stop mechanism comprising a worm gear mechanism disposed in engagement with said drive mechanism, wherein said worm gear mechanism comprises a helical drive and a helical gear having intermeshing teeth.

3. The railcar door assembly of claim 2, wherein said drive mechanism includes a gear segment selectively rotatable to effect rotation of said elongated member.

4. The railcar door assembly of claim 3, wherein said gear segment comprises a spur gear.

5. The railcar door assembly of claim 2, further including an operating mechanism operatively associated with said drive mechanism for selectively rotating said drive mechanism.

6. The railcar door assembly of claim 2, wherein said helical drive includes a first shaft having a handle secured thereto for selectively rotating said drive mechanism.

7. The railcar door assembly of claim 6, wherein said helical drive includes a second shaft having a first end and a second end with said helical gear mounted on said second shaft first end, and with a worm gear mounted on said second shaft second end.

8. The railcar door assembly of claim 7, wherein said worm gear includes teeth which are in continuous engagement with teeth on a spur gear segment included as part of said drive mechanism.

9. The railcar door assembly of claim 8, wherein when said handle is rotated for moving said railcar door to a fully opened position said worm gear rotates said gear segment in one direction and prevents gear segment movement in the opposite direction to thereby prevent drifting of said door.

10. The railcar door assembly of claim 8, wherein when said handle is rotated for moving said railcar door to a fully closed position said worm gear rotates said gear segment in one direction and prevents gear segment movement in the opposite direction to thereby prevent spinning of said handle.

11. A railcar door assembly comprising:

at least one sheet member comprising a front surface;

at least one channel disposed laterally across said front surface of said sheet member;

at least one elongated support member rotatably mounted to said channel via a mounting mechanism, said support member comprising at least one rotatable member secured to an end of said support member;

a gear segment operably connected to said elongated support member to effect rotation of said support member, said gear segment being mounted on a bearing plate on said sheet member front surface; and, a worm drive mechanism disposed in operative engagement with said gear segment for selectively rotating said gear segment to shift said door to one of a predetermined fully opened position and a fully closed position, said worm drive mechanism comprising a helical drive gear assembly, a first shaft, and a worm gear operably mounted to said first shaft in driving engagement with said gear segment.

12. The railcar door assembly of claim 11, further including a handle and said helical drive gear assembly further includes a second shaft, said handle being secured to said second shaft for selectively driving said worm drive mechanism.

13. The railcar door assembly of claim 11, wherein said worm gear includes teeth which are in continuous engagement with teeth on said gear segment.

14. The railcar door assembly of claim 11, further including an operating mechanism for selectively driving said worm drive mechanism.

15. The railcar door assembly of claim 12, wherein when said handle is rotated in a direction for selectively moving said railcar door to a fully opened position, said worm gear rotates said gear segment in the appropriate direction while preventing rotation in the opposite direction to eliminate the potential for undesired drifting of said door.

16. The railcar door assembly of claim 12, wherein when said handle is rotated in a direction for selectively moving said railcar door to a fully closed position, said worm gear rotates said gear segment in the appropriate direction while preventing rotation in the opposite direction to eliminate the potential for undesired spinning of said handle.

17. An anti-spin/anti-drift locking assembly for use in an associated railcar door system including a bearing plate located on a front surface of said door, and a gear segment mounted to said bearing plate for selectively driving said door to one of a fully opened and fully closed position, said locking assembly comprising:

a first shaft having a first end and a second end;

a helical gear disposed on said first end of said first shaft;

a worm gear disposed on said second end of said first shaft for operative rotational engagement with said gear segment; and, a helical drive operatively communicating with said helical gear.

18. The anti-spin/anti-drift locking assembly of claim 17, wherein said worm gear includes teeth which are in continuous engagement with teeth on said gear segment.

19. The anti-spin/anti-drift locking assembly of claim 17, further including an operating mechanism for selectively rotating said worm gear.

20. The anti-spin/anti-drift locking assembly of claim 19, wherein said helical drive includes a second shaft and said operating mechanism comprises a handle secured to said second shaft for selectively imparting rotational movement thereto.

21. The anti-spin/anti-drift locking assembly of claim 19, wherein when said worm gear is rotated through said operating mechanism in one direction, said gear segment is rotated by said worm gear in the opposite direction for moving said railcar door to a fully opened position, said worm gear preventing rotation of said gear segment in said one direction to thereby eliminate potential for undesired drifting of said door.

22. The anti-spin/anti-drift locking assembly of claim 20, wherein when said worm gear is rotated through said operating mechanism in one direction said gear segment is rotated by said worm gear in the opposite direction for moving said railcar door to a fully closed position, said worm gear preventing rotation of said gear segment in said one direction to thereby eliminate the potential for undesired spinning of said operating mechanism.

* * * * *